United States Patent [19]

Kageyama et al.

[11] Patent Number: 4,518,244

[45] Date of Patent: May 21, 1985

[54] HEAT FIXER ROLL WITH AN EVAPORATED METAL SURFACE

[75] Inventors: Katsuaki Kageyama; Ysushi Adachi, both of Chiba, Japan

[73] Assignee: Toray Silicone Company, Ltd., Tokyo, Japan

[21] Appl. No.: 436,744

[22] Filed: Oct. 25, 1982

[30] Foreign Application Priority Data

Oct. 29, 1981 [JP] Japan ..... 56-173252

[51] Int. Cl.[3] ..... G03G 15/20

[52] U.S. Cl. ..... 355/3 FU; 29/132; 219/469

[58] Field of Search ..... 355/3 FU; 219/216, 469; 432/60, 228; 118/60, 101; 430/99; 29/130, 132; 216/388

[56] References Cited

U.S. PATENT DOCUMENTS

| | | | |
|---|---|---|---|
| 3,809,854 | 5/1974 | Sanders | 219/469 X |
| 4,257,699 | 3/1981 | Lentz | 219/216 |
| 4,320,714 | 3/1982 | Shimazaki et al. | 219/216 |

OTHER PUBLICATIONS

*Research Disclosure,* No. 208, Aug. 1981, "Composite Fuser Roller", pp. 325–326.

*Xerox Disclosure Journal,* vol. 7, No. 2, Mar./Apr. 1982, p. 93, Ewing, J. R., "Conductive Rolls".

*Primary Examiner*—A. T. Grimley

*Assistant Examiner*—J. Pendegrass

*Attorney, Agent, or Firm*—Roger H. Borrousch

[57] ABSTRACT

A heat fixer roll made from a core covered with a layer of heat-resistant rubber coated with a layer of evaporated metal is useful in dry type electric photocopying machine to prevent the offset phenomenon.

5 Claims, 1 Drawing Figure

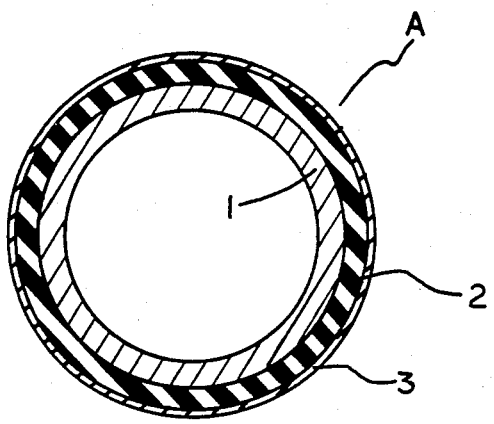
A
1
2
3

HEAT FIXER ROLL WITH AN EVAPORATED METAL SURFACE

BACKGROUND OF THE INVENTION

1. Field of the Invention

This invention relates to a heat fixer roll which is used in the contact heat fixing system of a dry type electric photocopying machine.

2. Description of the Prior Art

The most common process in the electric photocopying machine is the formation of the image over a photosensitive plate as an electrophotograph using a pigment-containing thermoplastic resin powder, known as a toner. The toner image is transferred to the copy paper and then fixed. As one method for fixing the toner image, a contact heat fixer system is often applied. In this contact heat fixer system, a heated fixer roll whose roll body surface has been covered with a layer of a heat-resistant releasing material and a pressure roll whose roll body surface has been covered with a heat-resistant elastomer are pressed together and brought into contact under a constant pressure to fix the fused toner on the paper with the passage of the copy paper between the two rolls.

The known heat-resistant releasing materials for heat fixer rolls are polytetrafluoroethylene and heat-resistant rubbers such as silicone rubbers, fluorine rubbers, and chlorosulfonated polyethylene rubbers such as Hypalon. However, the following undesirable phenomenon occurs. When the toner image is fused and fixed with the heat fixer roll, part of the toner image supported over the copy paper adheres on the surface of the heat fixer roll. As a result, when an incoming copy paper is brought into contact with the heat fixer roll, toner image partially transferred from a prior copy paper is partially transferred to the incoming copy paper and, at the same time, part of the toner image from this incoming copy paper adheres on the heat fixer roll. This phenomenon is generally called the offset phenomenon in printing technology. Such offset is an undesirable phenomenon in the process of fixing toner images. In order to prevent the occurrence of the offset phenomenon, the most commonly applied technique is the application of silicone oil over the heat fixer roll.

In such a contact heat fixer system, the surface of the heat fixer roll will be elastic since a coating of a heat-resistant rubber such as a silicone rubber as the heat-resistant releasing material has been applied over the surface at a constant thickness.

An advantage of a rubber coated roll is that unfixed toner is less frequently flattened resulting in excellent image quality. However, when a heat-resistant rubber is used and particularly in the case of silicone rubber, swelling of the rubber by the silicone oil added to prevent the offset is a significant problem. The heat resistance and abrasion resistance are significantly impaired by such swelling. For this reason, roll life is limited to 20,000 to 100,000 copies.

On the other hand, since a heat fixer roll which has been coated with polytetrafluoroethylene exhibits poor elasticity, problems occur in that the toner image is flattened during the fixing process so that image quality is stiff and in that neutral tints in photographic copying cannot be clearly fixed.

A common drawback of a polytetrafluoroethylene-coated heat fixer roll or a heat fixer roll coated with a heat-resistant rubber such as a silicone rubber is that the copy paper becomes entangled around the roll due to charging of the silicone oil added for the prevention of the offset phenomenon, due to charging between the heat fixer roll and the copy paper, or the pressure roll and the copy paper.

In an attempt to solve these drawbacks, separation pawls are generally attached with the heat fixer roll and pressure roll as a countermeasure. The inventors earnestly carried out the present investigation in an attempt to overcome the drawbacks of the conventional techniques and this invention was achieved as a result.

SUMMARY OF THE INVENTION

This invention relates to a heat fixer roll suitable for use in a dry type electric photocopying machine comprising a cylindrical roll body whose outer surface is covered with a heat-resistant rubber layer and an evaporated metal layer covers the heat-resistant rubber layer.

BRIEF DESCRIPTION OF THE DRAWING

The FIGURE shows a cross section of a heat fixer roll of this invention.

DESCRIPTION OF THE EMBODIMENTS

The heat fixer roll of this invention a roll body, a heat-resistant layer, and an evaporated metal layer. The roll body's cross section 1 of the FIGURE is circular and it may or may not be hollow. However, a hollow roll body, as shown in the FIGURE, is generally used. The roll body can be heated by a built-in electric heater or by the use of a heat medium. Many materials can be used for the roll body, but aluminum, aluminum alloy, iron, stainless steel, and ceramics are generally used.

The roll body is covered with a cured heat-resistant rubber. The heat-resistant rubber is adhered over the roll body by the application of an adhesion accelerator or by coating a primer over the roll body. The thickness of the heat-resistant rubber layer can be varied over a broad range, but it generally ranges from 0.5 to 2 mm. The hardness of the heat-resistant rubber can be varied over a broad range, but it generally ranges from 30 to 65 on the Shore A scale.

Examples of the heat-resistant rubber are silicone rubbers, fluorine rubbers, chlorosulfonated polyethylene rubbers, and acrylic rubbers. Silicone rubber is most suitable in terms of heat resistance, compressive set resistance, and releaseability with toner.

Many types of silicone rubber can be used, such as heat curing types vulcanized with a platinum catalyst and crosslinkers containing SiH, and room temperature-curing types vulcanized with moisture sensitive crosslinkers. With respect to the type of polymer, an ordinary methyl silicone rubber or fluorosilicone rubber is applicable. The silicone rubber layer is covered with an evaporated metal layer. The thickness of the evaporated metal layer generally ranges from $10^{-8}$ to $5\times10^{-7}$ meters (10 to 500 millimicrons), preferably ranges from $10^{-7}$ to $2\times10^{-7}$ meters. If the thickness of the metal layer is less than $10^{-8}$ meters, the heat-resistant rubber layer may be exposed or swelling of the rubber layer by the silicone oil may occur. If this thickness of the metal layer exceeds $5\times10^{-7}$ meters, the elasticity of the heat-resistant rubber is degraded and the image tends to become stiff. The type of metal evaporated on the surface is that type used for evaporation over plastics or rubbers, such as chromium alloy, chromium, titanium, aluminum, nickel, and silver.

In the FIGURE, the heat fixer roll A is constituted as follows. The exterior surface of a hollow roll body 1 is covered with a heat-resistant rubber layer 2 which is then covered with an evaporated metal layer 3. For example, the heat fixer roll of this invention can be manufactured as follows.

A metal (i.e., aluminum) core 1 is cleaned and a primer (i.e., DY39-012 primer by Toray Silicone Co., Ltd., Tokyo, Japan) is coated over it. An uncured methyl silicone rubber (SH52u by Toray Silicone Co., Ltd., Tokyo, Japan) which has been blended in advance with an organic peroxide vulcanizing agent, is wrapped around the primer-coated metal core. The resulting metal core is then placed in a metal mold, heated and maintained under pressure for a certain period. Then, the metal core covered with the cured silicone rubber is removed from the metal mold. The heating temperature depends upon the type of organic peroxide used and generally ranges from 110° C. to 180° C. The curing time generally ranges from 5 to 30 minutes. The surface of the roll coated with the heat-resistant rubber is uniformly polished followed by metal evaporation coating or is treated by glow discharge followed by metal evaporation coating. Metal evaporation is carried out as follows. The roll coated with the heat-resistant rubber which has been polished or treated by glow discharge is placed in a metal evaporation system. The added metal is evaporated by heating in vacuo and deposited over the heat-resistant rubber layer. The evaporation temperature is selected as appropriate from a consideration of the type of metal used and the rubber material coating the heat fixer roll. It is generally selected in the range around 200° C.

From the standpoint of improving the adhesion, a primer treatment of the heat-resistant rubber surface is preferred prior to metal evaporation. The heat fixer roll obtained as above does not exhibit the offset phenomenon which is ordinarily found for conventional heat fixer rolls. Since the surface is covered with a metal, charging by friction does not occur and the copy paper is therefore not entangled around the roll. Since a heat-resistant rubber is used beneath the evaporated metal layer in the heat fixer roll of this invention, the image quality in the toner fixing process and the heat resistance are by no means inferior to those of a heat fixer roll using a conventional heat-resistant rubber.

Because the surface of the heat fixer roll of this invention is covered with a metal layer, the heat-resistant rubber layer is not adversely affected by the silicone oil applied to prevent the offset phenomenon and therefore the life of the heat fixer roll is remarkably increased.

Because the heat fixer rolls of this invention, especially those employing silicone rubber, exhibit excellent heat resistance, prevention of the offset phenomenon, prevention of friction charging, prevention of entanglement of the copy paper around the roll, and resistance to the offset prevention fluid, they are very useful as the heat fixer roll in dry type electric photocopying machines.

That which is claimed is:

1. A heat fixer roll suitable for use in a dry type electric photocopying machine comprising a cylindrical hollow roll body whose outer surface is covered with a heat-resistant rubber layer having a thickness in the range of from 0.5 to 2 millimeters and an evaporated metal layer having a thickness in the range of $10^{-8}$ and $5\times10^{-7}$ meters covers the heat-resistant rubber layer.

2. The heat fixer roll according to claim 1 in which the heat-resistant rubber layer is a rubber selected from the group consisting of silicone rubbers, fluorine rubbers, chlorosulfonated polyethylene rubbers, and acrylic rubbers, and the evaporated metal layer is a metal selected from the group consisting of chromium alloy, chromium, titanium, aluminum, nickel, and silver.

3. The heat fixer roll according to claim 2 in which the heat-resistant rubber layer is a silicone rubber layer where the silicone rubber has a Shore A hardness in the range of 30 to 65.

4. The heat fixer roll according to claim 3 further comprising a primer coating over the outer surface of the roll body, the heat-resistant silicone rubber layer covering the primer coating, and said silicone rubber layer having a polished surface before the evaporated metal layer is applied.

5. The heat fixer roll according to claim 3 further comprising a primer coating over the outer surface of the roll body, the heat-resistant silicone rubber layer covering the primer coating, and said silicone rubber layer having its surface treated by glow discharge before the evaporated metal layer is applied.

* * * * *

UNITED STATES PATENT AND TRADEMARK OFFICE

CERTIFICATE OF CORRECTION

PATENT NO. : 4,518,244

DATED : May 21, 1985

INVENTOR(S) : Katsuaki Kageyama and Yasushi Adachi

It is certified that error appears in the above-identified patent and that said Letters Patent is hereby corrected as shown below:

In Column 2, line 61, the word "meters" should read "metres"

In Column 2, line 62, the word "meters" should read "metres"

In Column 2, line 65, the word "meters," should read "metres,"

In Column 4, line 21, the word "millimeters" should read "millimetres"

In Column 4, line 22, the word "and" should read "to"

In Column 4, line 23, the word "meters" should read "metres"

Signed and Sealed this

*Fourth* Day of *March 1986*

[SEAL]

*Attest:*

DONALD J. QUIGG

*Attesting Officer*

*Commissioner of Patents and Trademarks*